US006637671B2

(12) United States Patent
Swanson et al.

(10) Patent No.: US 6,637,671 B2
(45) Date of Patent: Oct. 28, 2003

(54) REDUCED RISK DISPENSING OF PETROLEUM DISTILLATE BASED HOUSEHOLD PRODUCTS

(75) Inventors: Judith E. Swanson, Racine, WI (US); Timothy I. Moodycliffe, Milwaukee, WI (US); Benjamin T. White, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 185 days.

(21) Appl. No.: 10/007,243

(22) Filed: Oct. 22, 2001

(65) Prior Publication Data

US 2003/0083208 A1 May 1, 2003

(51) Int. Cl.[7] ..... A62C 13/62; A62C 13/66

(52) U.S. Cl. ..... 239/302; 239/318; 222/340; 134/40; 510/365; 510/417

(58) Field of Search ..... 239/310, 318, 239/327, 311, 106, 333, 302; 222/340, 153.01; 134/40, 42, 3, 26; 510/365, 417, 461

(56) References Cited

U.S. PATENT DOCUMENTS

| | | | | | |
|---|---|---|---|---|---|
| 4,167,245 | A | * | 9/1979 | Kock et al. | 239/11 |
| 4,204,614 | A | * | 5/1980 | Reeve | 222/153.14 |
| 4,810,407 | A | | 3/1989 | Sandvick | 252/90 |
| 5,341,965 | A | * | 8/1994 | Maas et al. | 222/340 |
| 5,602,091 | A | | 2/1997 | Monson et al. | 510/406 |
| 5,879,694 | A | | 3/1999 | Morrison | 424/405 |
| 5,957,388 | A | * | 9/1999 | Franz | 239/327 |
| 6,325,304 | B1 | * | 12/2001 | Brite et al. | 239/333 |
| 6,398,133 | B1 | * | 6/2002 | Schultz | 239/327 |

FOREIGN PATENT DOCUMENTS

| | | | |
|---|---|---|---|
| EP | 0 839 907 | 5/1998 | C11D/17/04 |
| JP | 6293882 | 10/1994 | C08F/220/22 |

* cited by examiner

*Primary Examiner*—Gregory E. Webb

(57) ABSTRACT

A dispenser for petroleum distillate based household products, such as furniture oil, baby oil, or the like, comprises a non-pressurized spray bottle comprising a reduced volume spray apparatus which dispenses less than about 0.8 ml per actuation, and a removal resistant neck closure which does not permit closure removal or easy opening of the container. Lower risk is also obtained by addition of a thixotropic thickener to the petroleum distillate based product, to provide a product having a viscosity of greater than 100 SUS at rest at 100° F., but which exhibits shear-thinning, so as to be capable of being dispensed as a spray or fine mist by a non-pressurized spray dispenser or pump. Still further risk lowering may be attained by the addition of an effective amount of a bittering or aversion agent so as to substantially discourage voluntary ingestion of the petroleum distillate based product.

20 Claims, No Drawings

REDUCED RISK DISPENSING OF PETROLEUM DISTILLATE BASED HOUSEHOLD PRODUCTS

RELATED APPLICATION(S)

Not applicable.

FEDERALLY SPONSORED RESEARCH OR DEVELOPMENT

Not applicable.

BACKGROUND OF THE INVENTION

1. Field of the Invention

The present invention relates to an improvement in hazard reduction in the dispensing of petroleum distillate based household products by means of a spray means, such as a trigger spray or pump activated spray bottle.

2. Background Information

Petroleum distillate products are known for use in any number of products, including such common household products as baby oil and furniture polish, and in combination with other chemicals as a vehicle or solvent, but are also known to possess highly dangerous properties if ingested or aspirated. Accordingly, restrictions have been placed upon such products as petroleum distillate based furniture polishes, such that non-emulsion liquid furniture polish products containing greater than 10 percent petroleum distillate essentially may not be legally marketed in a trigger sprayer at the present time. Since consumers are known to prefer to apply such liquids as cleaning compositions by means of trigger sprayers or pump bottles, it may be anticipated that consumers would welcome such petroleum distillate containing household products as furniture polish, tanning oil, baby oil, after-bath spritz, or insect repellent, in a non-pressurized spray bottle. However, to date, no such products are available which meet the requirements of the Consumer Product Safety Commission (hereinafter CPSC) that the petroleum distillate composition exhibit a viscosity of greater than 100 SUS (Saybolt Universal Seconds) at 100° F. [16 CFR 1700.14 (a) (2)]. Further, it has been announced that the CPSC has approved regulations which require child-resistant packaging for most oil-based household products, including baby oils, body oils, massage oils, sunscreens, cleaning solvents, water repellents, automotive cleaners, and cosmetics such as makeup removers and bath oils. These new regulations of the CPSC would apply to thin, watery products containing more than 10 percent hydrocarbon by weight, which flow freely and can be inhaled or aspirated when swallowed. Since thicker, more viscous liquids are less likely to be inhaled, these requirements will apparently not apply to such liquids. Therefore, it is considered desirable to provide thickened petroleum distillate based household products which exceed the minimum viscosity requirements of the CPSC, but which are capable of being dispensed as a spray or fine mist by means of a spray or pump dispensing means in combination with a non-pressurized container. To further protect the public, and especially children, from ingestion of such petroleum distillate containing household products, it is also preferred that the dispensing means be capable of dispensing only a small amount of the product per actuation, and the neck closure of the spray unit as attached to the container be such that the spray unit may not be readily removed, and the container may not be readily opened. Still further, it is preferable that the product to be dispensed incorporate a bittering agent or aversion agent such as to strongly discourage a child or other person from ingestion of the product.

Although reduced volume trigger spray mechanisms are known, and neck closures such as those of a staked or ratcheted nature have been used in the past, no petroleum distillate based household products have been proposed wherein the product is provided in a non-pressurized container incorporating these devices, and wherein the product further incorporates a viscosity modification agent to permit spray delivery of a thickened product, and an aversion agent to further inhibit or prevent ingestion thereof.

BRIEF SUMMARY OF THE INVENTION

To achieve the foregoing and other advantages, the present invention provides for the dispensing of a liquid phase petroleum distillate product from a non-pressurized container by spray application to a surface. To achieve the appropriate degree of hazard reduction desirable for such spray distribution of such materials as furniture oil, baby oil, or other petroleum distillate containing liquids, the viscosity of the liquid composition is modified so as to exceed 100 SUS at a temperature of 100° F. In addition, the spray means comprise a neck closure inhibiting the opening of the spray bottle, and means to limit the amount of product sprayed per actuation to a limited volume of material thought to be less than an aspirable quantity. Thus, the dispenser utilized in the present invention comprises an actuation means which prevents spraying an aspirable volume of petroleum distillate material, and the neck closure is selected so as to prevent or at least inhibit opening of the bottle and potential ingestion of large quantities of product containing the petroleum distillate.

To increase the safety of dispensing petroleum distillate products such as furniture oil, the composition utilizes a thixotropic thickener to provide a liquid of elevated viscosity when at rest, but which thins down to form a mist when sprayed. The liquid then thickens after spraying to a higher viscosity before coming in contact with the surface toward which it has been sprayed. By providing such a modified petroleum distillate product, the present invention also overcomes several problems inherent in conventional products such as mineral oil or mineral spirits, often used in such products as furniture polish. Conventional products of this nature tend to run down vertical surfaces, due to low viscosity, making wiping more difficult. More importantly, such lower viscosity petroleum distillate products are harmful if swallowed. The modified products of the present invention, however, run more slowly down vertical surfaces, and thicken before contacting the back of a person's throat if sprayed in that direction. Moreover, whereas most thin mineral oils are difficult to dispense as a spray from a non-pressurized container, because they can form a stream rather than a mist when dispensed, the thickened mineral oils of the present invention form a spray upon dispensing through a trigger spray or pump dispenser mechanism.

DETAILED DESCRIPTION OF THE INVENTION

The present invention extends to any petroleum distillate or oil based household product, but particularly to those comprising more than 10 percent by weight of the petroleum distillate. The petroleum distillate may be present as a solvent, or as a carrier for other materials. Household products of particular interest are such products as furniture oil, baby oil, and various oil based cleaning compositions.

The petroleum distillates to which the present invention pertains include such commonly utilized materials as mineral oil, mineral spirits, naphthenic oil, silicone oil, isoparaffinic hydrocarbon solvents, kerosene, and the like, and mixtures thereof.

The thickeners found to be of value in respect to the present invention comprise thickeners which provide shear-thinning attributes to a petroleum distillate, wherein there is essentially no water present. Thus the present invention is not intended for use with oil-in-water, or water-in-oil emulsions employing petroleum distillates, all though it is theorized that such thickeners may be effective with water-in-oil emulsions wherein the water phase is entirely encapsulated in the oil phase.

While it is possible that any shear-thinning thixotropic thickener compatible with a non-aqueous petroleum distillate composition would be effective, a very limited number of such thickeners have been found to be of value in the present invention. One such shear-thinning thixotropic thickener is Versagel™ M 1600, a mineral oil/Kraton® block terpolymer available from Penreco. Kraton® is a commercially available thermoplastic rubber type polymer, sold by Shell Chemical Company. This oil/copolymer material, as described in U.S. Pat. No. 5,879,694, (incorporated herein by reference) has been used in the past for the manufacture of gel candles, but has now been found to act as a thixotropic thickener when mixed with petroleum distillates in the absence of water Such block copolymer blends with hydrocarbon oil, such as paraffinic oil, naphthenic oil, natural mineral oil, and particularly white oil, constitute a preferred shear-thinning thixotropic thickener for use with non-aqueous petroleum distillate products.

Another suitable thickener has been found to be N-Lauroyl glutamic acid di-n-butylamide, which has been found to thicken mineral oil to a relatively high viscosity while permitting the thus thickened oil to be sprayed through a spray applicator.

Such thixotropic thickeners may be used quite sparingly, since the addition of very small amounts thereof will cause the viscosity of the petroleum distillate to increase rapidly. For example, the addition of 9.0 percent of Versagel™ M 1600 to mineral oil having a viscosity of 50 SUS rapidly results in a thickened composition having a viscosity of 180 SUS. It may be seen that the addition of excessive thickener may result in a composition which, even with shear-thinning properties, will be too viscous to be sprayed. By careful selection of the appropriate thixotropic thickening agent for any specific petroleum distillate, one may thicken the chosen petroleum distillate in such a manner that it may be applied to a surface by means of a non-pressurized spray mechanism, while still maintaining a high viscosity at rest, so as to be packaged in a conventional container without requiring special packaging called for by the CPSC. For purposes of the present invention, it is suggested that from about 0.1 to about 15 percent by weight of the thickener be present in the thickened petroleum distillate product. Preferably, the thickener should be present in an amount of from about 0.2 to about 12 percent by weight, and more preferably from about 0.2 to about 9 percent.

In addition to thickening the petroleum distillate component of the composition to be dispensed, it is important, for safety purposes, to select an appropriate spray mechanism, so as to dispense a limited amount of petroleum distillate based household product per actuation. It has been found that as little as 0.8 to 1.6 ml of a petroleum distillate ingested by a child weighing from 10 to 20 kg. may result in an aspiration hazard. So as to minimize danger from ingestion, it is proposed that the amount of petroleum distillate released per actuation be limited to below 0.8 ml, and preferably no more than 0.65 ml. Reduced volume or metering trigger devices are known in the art, and are available from such suppliers as Saint-Gobain Calmar Corporation.

Still further, it is desirable to prevent deliberate, or inadvertent, opening of the spray bottle, which could result in spillage and ingestion of the contents. Accordingly, it is preferred to package such petroleum distillate based household products in a container having a removal resistant closure, such as either a ratcheted, staked-on, crimped, or otherwise difficult to open neck closure. A ratcheted neck closure (identified as "24 external rib 28/400 non removable) and a trigger assembly (identified as "TS-800-2"), are available from Saint-Gobain Calmar Corporation, and are suitable for the purpose of this invention.

A further safe guard may be incorporated into the present invention, by the addition of a small but effective amount of an aversion agent, such as a bittering agent. Any petroleum distillate compatible bittering or aversion agent may be employed, such as materials selected from the group consisting of denatonium benzoate, denatonium saccharide, denatonium chloride, sucrose benzoate, quinine, quinine hydrochloride, quinine sulfate, brucine, brucine sulfate, quassia, quassin, naringin, limonin, phenylthiocarbamide, quebracho, sucrose octaacetate, quercetin, berberine, and combinations thereof. The most preferred aversion material for use in the present invention is denatonium benzoate, commercially available from Macfarlan Smith Limited, Scotland, as Bitrex™. This composition, widely known as among the most bitter compositions in the world, has been found to be particularly useful in the present invention, due to the relatively low concentrations thereof required. For example, it has been found that as little as 0.01 percent by weight of a 25% solution of Bitrex™ in mineral oil is effective in bittering a petroleum distillate based household product to the extent that a child (or even an adult) would be highly unlikely to ingest more than a minute quantity. Effective amounts of the bittering agents will vary in accordance with the specific bittering or aversion agent employed, but it has been found that from about 0.0010 to about 0.050 percent by weight of denatonium benzoate is effective, with from 0.0025 to about 0.010 percent by weight, based upon the total weight of the petroleum distillate composition, is preferred. While some difficulty may be encountered in solubilizing the bittering agent, such as denatonium benzoate, in the petroleum distillate utilized in the present invention, such as mineral oil, a small amount of ethanol may be employed as a solubilizing agent to achieve dispersal of the agent in the oil.

EXAMPLE A

A spray bottle comprising the above identified ratcheted neck closure and trigger assembly was assembled, and filled with a sprayable liquid to determine the suitability thereof for use in the present invention. The neck closure was found to be very difficult to open, opening only after repeated attempts and use of considerable force. When the trigger spray was actuated, it was found to dispense only about 0.65 ml per actuation, which amount was considered to be within the volume range desired.

EXAMPLE B

Tests were conducted to determine the effect of Bitrex™, and it was found that at a level of 50 parts per million (0.005%), Bitrex™ containing compositions were very distasteful to 9 of 10 people, while the same composition without the aversion agent was acceptable.

EXAMPLE C

A test product containing a petroleum distillate was prepared, in which the oil based product contained a viscosity modification agent and an aversion agent. The composition of the test product, suitable for use as a furniture polish, was as follows:

| | |
|---|---|
| 80.5% | Mineral oil, 50 SUS (carrier) |
| 8.5% | Versagel ™ M1600 (thickener) |
| 4.0% | d-Limonene (solvent/cleaner) |
| 5.0% | Silicone oil, 20 centistokes viscosity (polish) |
| 1.0% | Orange Blast RN-2259 (Perfume) |
| 0.002% | Sandoblast Yellow (Azo dye) |
| 0.020% | Bitrex ™ 25% solution in ethanol (aversion agent) |
| 1.0% | Mazol ™ PG031K monooleate (solubilizer) |

This composition exhibited a viscosity at rest of 180 SUS at 100° F. A composition having such a viscosity would not normally be sprayable by a trigger spray mechanism, but due to the thixotropic nature of the Versagel™ thickener, a mixture of a triblock copolymer and a hydrocarbon oil, available from Penreco, the composition thinned down under the stress of passage through the trigger spray mechanism and nozzle, and was dispensed as a fine mist. Upon measurement of the volume of composition dispensed, it was found that less than 0.8 ml of liquid was dispensed per actuation of the trigger sprayer. Further, the liquid which condensed rapidly from the spray mist was found to be extremely bitter in taste, such that one would most likely not knowingly voluntarily ingest additional liquid once one had tasted the spray mist or the liquid formed therefrom.

INDUSTRIAL APPLICABILITY

The reduced risk dispenser, and the method for more safely dispensing petroleum distillate based household products, may be readily obtained by the addition to the product of a unique combination of additive materials, comprising a thixotropic thickener and a bittering or aversion agent, and the packaging of the product in a non-pressurized spray container having a reduced volume spray apparatus and a removal resistant neck closure, to provide a more convenient, but lower risk means for spray application of petroleum distillate based household products.

We claim:

1. A method for dispensing a petroleum distillate based household product, comprising dispensing said product from a container having a reduced volume spray mechanism and a removal resistant neck closure, wherein the improvement comprises adding to said product a shear-thinning thixotropic thickener.

2. The method of claim 1, wherein said reduced volume spray mechanism dispenses less than about 0.8 ml of liquid per actuation, and said product comprises a petroleum distillate chosen from the group consisting of mineral oils, mineral spirits, naphthenic oils, silicone oils, isoparaffinic hydrocarbon solvents, kerosene, and mixtures thereof.

3. The method of claim 2, wherein said petroleum distillate product has a viscosity of from about 30 to about 130 SUS at 100° F. prior to addition of the thickener, and a viscosity of greater than about 100 SUS at 100° F. subsequent to the addition of the thickener, and said product containing said thickener forms a spray upon passage through said spray mechanism.

4. The method of claim 3, wherein said thickener is chosen from the group consisting of a mixture comprising a triblock copolymer and a hydrocarbon oil, and N-Lauroyl glutamic acid di-n-butylamide, and comprises from about 0.2 to about 9 percent by weight of the product.

5. The method of claim 4, wherein said thickener comprises from about 2 percent to about 30 percent triblock copolymer and from about 70 percent to about 98 percent hydrocarbon oil.

6. The method of claim 5, wherein said product comprises a furniture oil.

7. The method of claim 6, wherein said furniture oil comprises a mineral oil and a silicone oil.

8. The method of claim 2, wherein the improvement further comprises adding to said product an aversion agent.

9. The method of claim 8, wherein the aversion agent is selected from the group consisting of denatonium benzoate, denatonium saccharide, denatonium chloride, sucrose benzoate, quinine, quinine hydrochloride, quinine sulfate, brucine, brucine sulfate, quassia, quassin, naringin, limonin, phenylthiocarbamide, quebracho, sucrose octaacetate, quercetin, berberine, and combinations thereof.

10. The method of claim 9, wherein the aversion agent is present in an amount of from about 0.0010 to about 0.050 percent by weight.

11. The method of claim 10, wherein the aversion agent is denatonium benzoate.

12. The method of claim 11, wherein the denatonium benzoate is present in an amount of from about 0.0025 to about 0.010 percent by weight.

13. A method for the dispensing of a petroleum distillate product selected from the group consisting of mineral oils, mineral spirits, naphthenic oils, silicone oils, isoparaffinic hydrocarbon solvents, and mixtures thereof, said method comprising applying said product to a surface by means of a reduced volume spray mechanism having a removal resistant neck closure, wherein said mechanism dispenses less than about 0.8 ml of liquid per actuation.

14. The method of claim 13, further comprising adding to said product a shear-thinning thixotropic thickener comprising from about 2 percent to about 30 percent triblock copolymer and from about 70 percent to about 98 percent hydrocarbon oil.

15. The method of claim 13, wherein said petroleum distillate product has a viscosity of from about 30 to about 130 SUS at 100° F. prior to addition of said thickener, and a viscosity of greater than about 100 SUS at 100° F. subsequent to the addition of said thickener, and said product containing said thickener forms a spray upon passage through said spray mechanism.

16. The method of claim 14, further comprising adding to said product an aversion agent.

17. The method of claim 16, wherein the aversion agent is selected from the group consisting of denatonium benzoate, denatonium saccharide, denatonium chloride, sucrose benzoate, quinine, quinine hydrochloride, quinine sulfate, brucine, brucine sulfate, quassia, quassin, naringin, limonin, phenylthiocarbamide, quebracho, sucrose octaacetate, quercetin, berberine, and combinations thereof.

18. The method of claim 17, wherein the aversion agent is present in an amount of from about 0.0010 to about 0.050 percent by weight.

19. The method of claim 18, wherein the aversion agent is denatonium benzoate.

20. The method of claim 19, wherein the denatonium benzoate is present in an amount of from about 0.0025 to about 0.010 percent by weight.

* * * * *